US009974997B2

(12) United States Patent
Cei

(10) Patent No.: US 9,974,997 B2
(45) Date of Patent: May 22, 2018

(54) METHOD FOR CONTROLLING THE OPERATION OF A TREADMILL, TREADMILL AND RELATED PROGRAM PRODUCT

(71) Applicant: TECHNOGYM S.P.A., Forli'-Cesena (IT)

(72) Inventor: Daniele Cei, Forli'-Cesena (IT)

(73) Assignee: TECHNOGYM S.P.A., Forli'-Cesena (IT)

( * ) Notice: Subject to any disclaimer, the term of this patent is extended or adjusted under 35 U.S.C. 154(b) by 5 days.

(21) Appl. No.: 15/354,408

(22) Filed: Nov. 17, 2016

(65) Prior Publication Data

US 2017/0136290 A1 May 18, 2017

(30) Foreign Application Priority Data

Nov. 18, 2015 (IT) ..... 102015000073898

(51) Int. Cl.
*A63B 24/00* (2006.01)
*A63B 22/02* (2006.01)
(Continued)

(52) U.S. Cl.
CPC ..... *A63B 22/025* (2015.10); *A63B 21/4035* (2015.10); *A63B 22/0235* (2013.01);
(Continued)

(58) Field of Classification Search
CPC ..... A63B 22/025; A63B 22/0235; A63B 2220/30; A63B 2220/51; A63B 2220/54;
(Continued)

(56) References Cited

U.S. PATENT DOCUMENTS 5,643,142 A * 7/1997 Salerno ..... A63B 22/02 482/1
6,443,875 B1 * 9/2002 Golen, Jr. ..... A63B 22/02 482/51

(Continued)

FOREIGN PATENT DOCUMENTS

WO 2007081607 A2 7/2007

OTHER PUBLICATIONS

Italian Search Report and Written Opinion dated Jul. 6, 2016.

*Primary Examiner* — Glenn Richman
(74) *Attorney, Agent, or Firm* — Arent Fox LLP; Michael Fainberg

(57) ABSTRACT

Disclosed are a treadmill and a method for controlling the operation of the treadmill. The method comprises: detecting, by at least one detecting sensor with which the treadmill is equipped, at least a first parameter representative of the interaction between a user and a physical exercise surface of the treadmill; providing at least one set reference value of a second parameter representative of the interaction between the user and the physical exercise surface; modulating, by means of the data processing unit, at least one electrical control parameter of an actuation device operatively associated with at least either a first rotary element and a second rotary element with which the treadmill is equipped, on the basis of said at least a first parameter the step of modulating being carried out to keep the second parameter equal to the set reference value of said at least a second parameter.

22 Claims, 6 Drawing Sheets

(51) Int. Cl.

| | |
|---|---|
| ***A63B 23/04*** | (2006.01) |
| ***A63B 21/00*** | (2006.01) |
| *A63B 69/00* | (2006.01) |
| *A63B 21/005* | (2006.01) |
| *A63B 21/012* | (2006.01) |

(52) U.S. Cl.
CPC ..... *A63B 23/04* (2013.01); *A63B 23/047* (2013.01); *A63B 24/0087* (2013.01); *A63B 21/0051* (2013.01); *A63B 21/0053* (2013.01); *A63B 21/012* (2013.01); *A63B 69/0057* (2013.01); *A63B 2024/0093* (2013.01); *A63B 2220/30* (2013.01); *A63B 2220/51* (2013.01); *A63B 2220/54* (2013.01); *A63B 2230/062* (2013.01)

(58) Field of Classification Search
CPC ..... A63B 2230/062; A63B 23/04; A63B 2400/0062; A63B 2400/0087; A63B 21/4035; A63B 21/0053; A63B 21/012; A63B 2024/0093; A63B 69/0057
See application file for complete search history.

(56) References Cited

U.S. PATENT DOCUMENTS

| | | | | |
|---|---|---|---|---|
| 6,450,922 | B1 | 9/2002 | Henderson et al. | |
| 6,626,803 | B1 * | 9/2003 | Oglesby ..... | A63B 22/02 482/51 |
| 6,676,569 | B1 | 1/2004 | Radow | |
| 7,815,549 | B2 * | 10/2010 | Crawford ..... | A63B 22/0056 482/52 |
| 2013/0123071 | A1 | 5/2013 | Rhea | |

* cited by examiner

METHOD FOR CONTROLLING THE OPERATION OF A TREADMILL, TREADMILL AND RELATED PROGRAM PRODUCT

CROSS-REFERENCE TO RELATED APPLICATIONS

The present application claims priority to Italian Patent Application No. 102015000073898 filed Nov. 18, 2015, the entire contents of which are incorporated herein by reference.

FIELD OF THE TECHNOLOGY

The present invention relates to the field of fitness, and in particular to a method for controlling the operation of a treadmill, to a treadmill, and to a related program product.

BACKGROUND

As known, treadmills are nowadays one of the most common exercise machines which can be employed by users for physical activities, e.g. running, walking and thrusting exercises, for training and for physical rehabilitation.

The technological development of treadmills aims at modifying and perfecting such exercise machines so that they can also and especially be used for more and more mutually diverse thrusting exercises, in addition to running or walking.

Furthermore, the need is strongly felt, even for the purposes of reducing times and costs, in particular for the user, to provide a treadmill on which a user can carry out and differentiate the physical exercises by always using the same exercise machine or at least by using it as much as possible.

SUMMARY

It is the object of the present invention to devise and provide a method for controlling the operation of a treadmill which allows to at least partially avoid the drawback described above with reference to the prior art. Such an object is achieved by means of a claimed treadmill and method for controlling the operation of a treadmill.

BRIEF DESCRIPTION OF THE DRAWINGS

Further features and advantages of the treadmill, of the method for controlling the operation, of the respective program product, and of the training methods according to the present invention will become apparent from the following description indicatively provided by way of non-limiting example with reference to the accompanying drawings, in which.

DETAILED DESCRIPTION OF THE EMBODIMENTS

Figure 1:
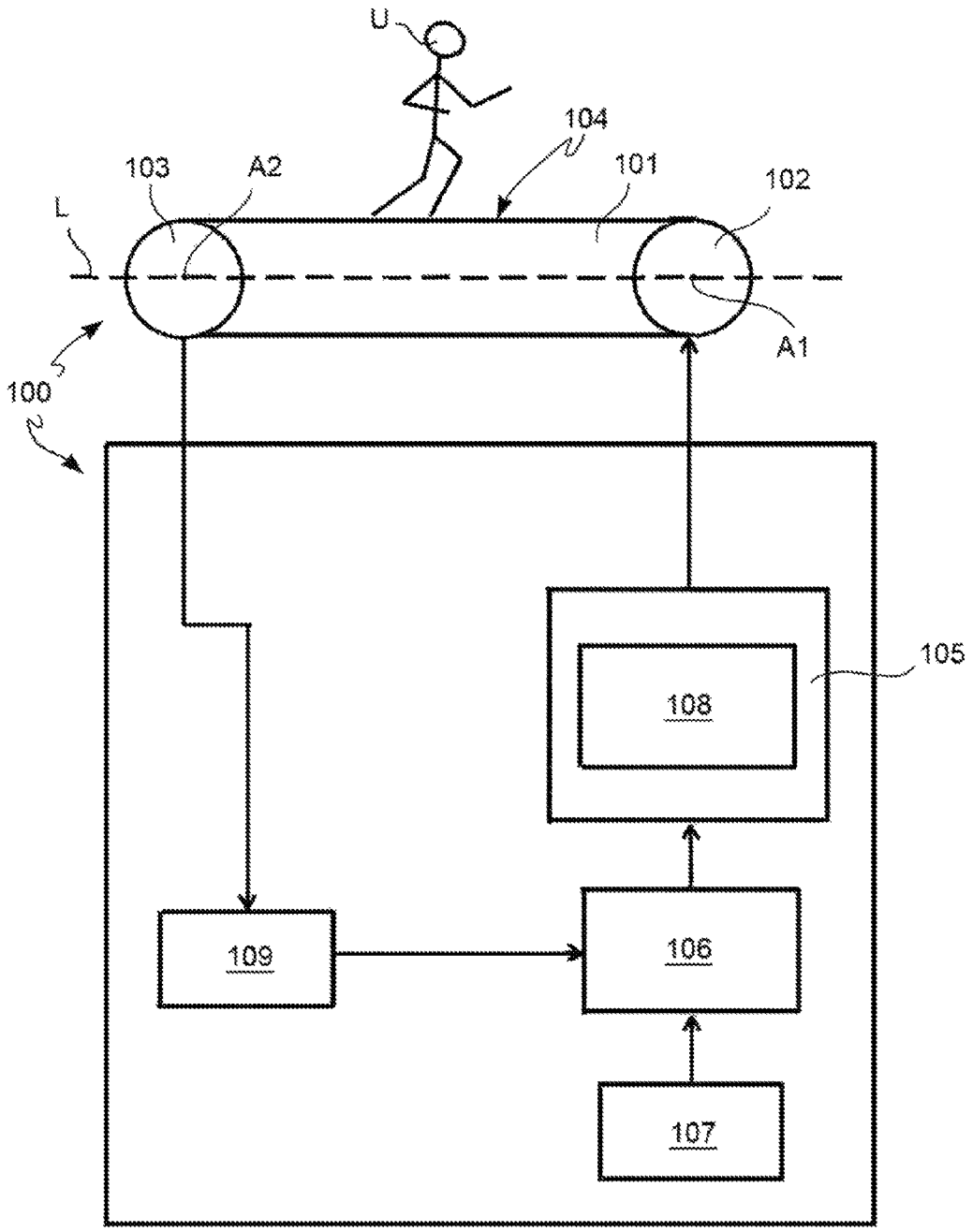
FIG. 1 shows, by means of a block chart, a treadmill with control of the respective operation according to an embodiment of the present invention.

With reference to FIG. 1, reference numeral 100 indicates as a whole a treadmill 100 with respective operation control, according to an embodiment of the invention.

It is worth noting that equivalent or similar elements are indicated by the same reference numeral in the aforesaid figures.

Firstly, it is worth noting that FIG. 1 shows an embodiment of the treadmill 100 and of some components showing them simply by means of a block chart in order to better highlight the technical features of the treadmill 100 and of its components which are essential and important for the present invention.

With particular reference to the embodiment shown in FIG. 1, the treadmill 100 comprises a base 101 extending along a longitudinal axis L, indicated by a dashed line in the figure.

The base 101 comprises a first rotary element 102 and a second rotary element 103 adapted to rotate about respective rotation axes (first rotation axis Al for the first rotary element 102, second rotation axis A2 for the second rotary element 203) transversal to the longitudinal axis L of the base 101 of the treadmill 100.

It is worth noting that the first rotary element 102 is arranged at an end of the base 101, whilst the second rotary element 103 is arranged at a second end of the base 101, opposite to said first end along the longitudinal axis L of the base 101.

The base 101 further comprises a physical exercise surface 104 operatively connected to the first rotary element 102 and to the second rotary element 103.

For the purposes of the present description, "physical exercise surface" means the rotational surface of the treadmill 100 on which a user U (diagrammatically shown in FIG. 1), by placing his or her feet or lower limbs in general, can carry out a physical exercise, such as, for example, running, walking, thrusting exercises, pulling exercises or any other type of physical exercise that the treadmill 100 allows.

Furthermore, it is worth noting that "rotary element" means any mechanical element adapted to rotate about a respective rotation axis so as to impart a rotation to the "physical exercise surface" operatively associated to one or more of these rotary elements. The type of rotary element, some examples of which will be described below, depends on the type of physical exercise surface to be rotated.

In greater detail, the rotation of the first rotary element 102 also causes the rotation of the physical exercise surface 104 and the second rotary element 103. In an entirely similar manner, the rotation of the second rotary element 103 causes the rotation of the first rotary element 102 and the physical exercise surface 104.

When the physical exercise surface 104 is moving, the advancement sense of the physical exercise surface 104, indicated by reference S1 in FIG. 1 (e.g. from right leftwards), is opposite to the advancement sense of the user U on the physical exercise surface 104, indicated in FIG. 1 by reference S2 (e.g. from the left rightwards).

Turning back to the embodiment shown in FIG. 1, the side profile of the physical exercise surface 104 is substantially parallel to the longitudinal axis L of the base 101. So, the treadmill 100, in this embodiment, is a so-called flat treadmill.

According to a further embodiment, alternative to the previous one and not shown in the figures, the side profile of the physical exercise surface 104 is substantially curved with respect to the longitudinal axis L of the base 101. So, the treadmill 100, in this embodiment, is a so-called curved treadmill.

It is worth noting that a curved treadmill has the particularity of being actuated by the movement of the legs of the user, who moves the physical exercise surface 104 by walking or running without the need for a motor.

According to an embodiment (not shown in the figure), in combination with any one of those described above, the physical exercise surface 104 comprises a belt wound about the first rotary element 102 and the second rotary element 103 and a support table (not shown in the figure), arranged between the first rotary element 102 and the second rotary element 103 along the longitudinal axis L of the base 101, on which the belt defining the physical exercise surface 104 runs.

In this embodiment, the first rotary element 102 and the second rotary element 103 comprise two respective rolls, each rotationally coupled to the base 101 of the treadmill 100 at the two ends of the base 101, to which the belt is connected.

According to a further embodiment (not shown in the figures), the physical exercise surface 104 comprises a plurality of strips transversal to the longitudinal axis L of the base 101.

In this embodiment, both the first rotary element 102 and the second rotary element 103 comprise two respective pulleys arranged near the side portions of the base 101, transversely to the longitudinal axis L of the base 101, adapted to support the plurality of strips at the side edges of each strip.

In other words, in this further embodiment, the physical exercise surface 104 has a slat configuration.

In particular, such a slat configuration is applied on treadmills with physical exercise surface 104 having a side profile substantially parallel with respect to the longitudinal axis L of the base 101 (flat treadmills) and on treadmills with physical exercise surface 104 having curved side profile (curved treadmills).

Figure 5:
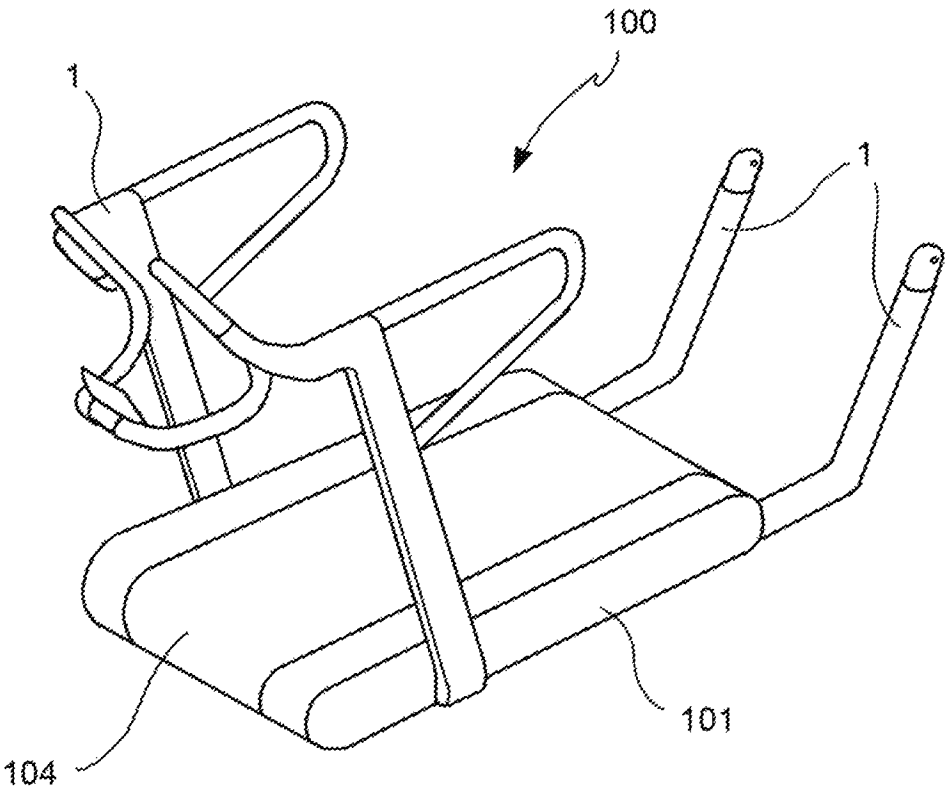
FIG. 5 diagrammatically shows an example of a treadmill according to any embodiment in FIGS. 1, 2 and 3, and FIG. 6 diagrammatically shows a data table which can be stored in a memory unit of the treadmill and used in the method for controlling the operation of the treadmill according to an embodiment of the invention.

Also referring now to FIG. 5, the treadmill 100 further comprises a frame 1 extending substantially in vertical direction with respect to the base 101.

The frame 1 is a combination of uprights and tubular elements operatively connected to one another and distributed so as to define a supporting structure which substantially surrounds the user U when he or she is on the physical exercise surface 104.

Such supporting structure comprises one or more rests for the user U, e.g. one or more bars, handles, grips, backrests or dedicated support for the torso or for the shoulders, and possibly also one or more tow couplings (not shown in the figure).

It is worth noting that the possible tow couplings, either alternatively or in combination with those present on the frame of the treadmill 100, may be either external to the treadmill 100, e.g. distributed on an external structure (e.g. an upright) positioned near the treadmill 100, or on a wall near where the treadmill 100 is positioned.

Turning back to the embodiment in FIG. 1, the treadmill 100 further comprises an actuation device 105 of the physical exercise surface 104 operatively associated with at least one of said first rotary element 102 and second rotary element 103.

The actuation device 105 of the physical exercise surface 104 will be simply referred to as "actuation device" hereinafter.

It is worth noting that "actuation" means any action which can be carried out on the physical exercise surface 104 such to condition the rotation thereof, i.e. starting, increasing or decreasing the speed, braking and so on.

The actuation device 105 comprises at least one element (e.g. of electrical, magnetic or electromagnetic type), operatively associated in a rotational manner with the base 101 of the treadmill 100.

The actuation device 105 is operatively connected to at least one of the first rotary element 102 and the second rotary element 103 so that a rotation of either the first rotary element 102 or of the second rotary element 103 corresponds to a rotation of the actuation device 105, and conversely a rotation of the actuation device 105 corresponds to a rotation of either the first rotary element 102 or the second rotary element 103.

"Rotation of the actuation device" means the rotation of at least one electrical member of the actuation device 105 operatively associated in a rotational manner with the base 101 of the treadmill 100.

It is worth noting that, in an embodiment, the actuation device 105 is operatively connected in a direct manner to at least one of the first rotary element 102 and the second rotary element 103.

According to a further embodiment, alternative to the previous one, the actuation device 105 is operatively connected, by means of a respective transmission member, to at least one of the first rotary element 102 and the second rotary element 103.

In an embodiment, the actuation device 105 is configured to apply a braking action on at least one of the first rotary element 102 and the second rotary element 103, and consequently on the physical exercise surface 104.

Furthermore, in a further embodiment in combination with the previous one, the actuation device 105 is configured to apply a driving action on at least one of the first rotary element 102 and the second rotary element 103, and consequently on the physical exercise surface 104.

The rotary element 100 further comprises a data processing unit 106, e.g. a microprocessor or a microcontroller.

The data processing unit 106 is operatively connected to the actuation device 105.

The treadmill 100 further comprises a memory unit 107, operatively connected to the data processing unit 106.

The memory unit 107 can be either internal or external (as shown in the FIG. 1, for example) to the data processing unit 106.

It is worth noting that the memory unit 107 is configured to store one or more program codes which can be executed by the data processing unit 106 to control the treadmill 100, and in particular to control the actuation device 105, in order to actuate the physical exercise surface 104, as will be described below.

In greater detail, the data which can be stored in the memory unit 107 comprise data related to the operation of the actuation device 105, on the basis of which the processing unit 106, as described below, may control the actuation device 105.

On more general level, further data which can be stored in the treadmill 100 are data related to the training programs/algorithms, on the basis of which the processing unit 106 can control the actuation device 105.

It is worth noting that these data are preferably stored in a further memory unit, different from the memory unit 107, arranged in the frame of the treadmill 100. The memory unit 107, as the data processing unit 106, is instead arranged in the base 101 of the treadmill.

Turning back to the actuation device 105, in an embodiment, shown in FIG. 1, the actuation device 105 comprises a motor 108, operatively associated with and controllable by the data processing unit 106.

In this embodiment, the motor 108 is configured to apply both the driving action and the braking action on at least one of the first rotary element 102 and the second rotary element 103, and thus on the physical exercise surface 104, on the basis of commands received from the data processing unit 106.

In this embodiment, examples of motors may be electrical brushless type motors, asynchronous electrical motors, variable reluctance electrical motors, direct current electrical motors, and so on.

It is worth noting that in this embodiment, the actuation device 105 is a device which transforms electrical energy into mechanical energy, and vice versa.

Figure 2:
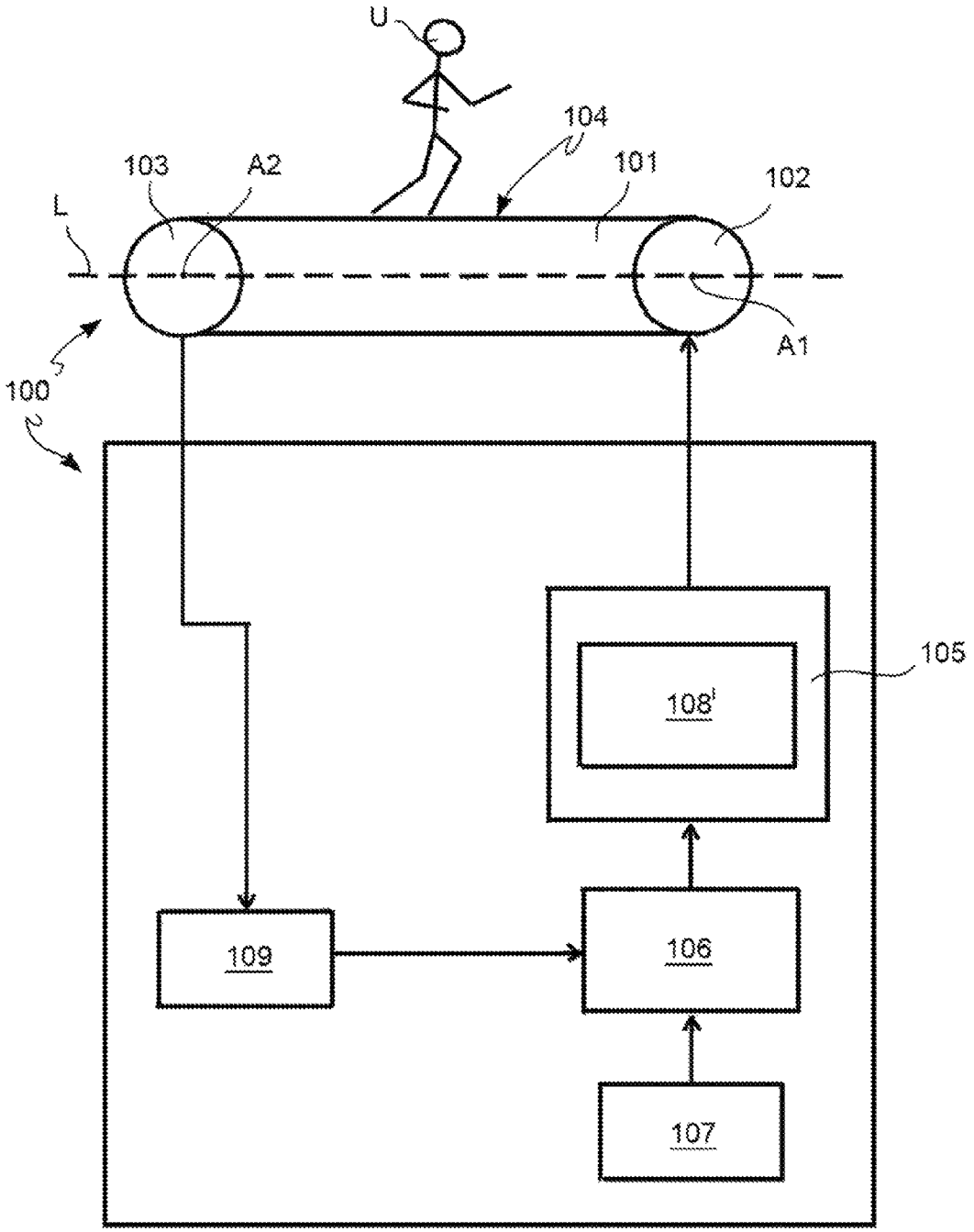
FIG. 2 shows, by means of a block chart, a treadmill with control of the respective operation according to a further embodiment of the present invention.

In a further embodiment, shown in FIG. 2, the actuation device 105 comprises a brake 108', operatively associated with and controllable by the data processing unit 106.

In this embodiment, the brake 108' is configured to apply the braking action on the physical exercise surface 104, on the basis of the commands received from the data processing unit 106.

It is worth noting that the braking action is applied on the physical exercise surface 104 by the brake 108' by acting on at least one of the first rotary element 102 and the second rotary element 103.

In this embodiment, examples of brakes 108' may be regenerative brakes (e.g. generators), permanent magnet magnetic brakes, eddy electrical current brakes, friction mechanical brakes, and so on.

It is worth noting that this embodiment can be advantageously applied in the case of curved treadmills (described above), in which there is no device (motor) adapted to apply a driving action on the physical exercise surface.

Figure 3:
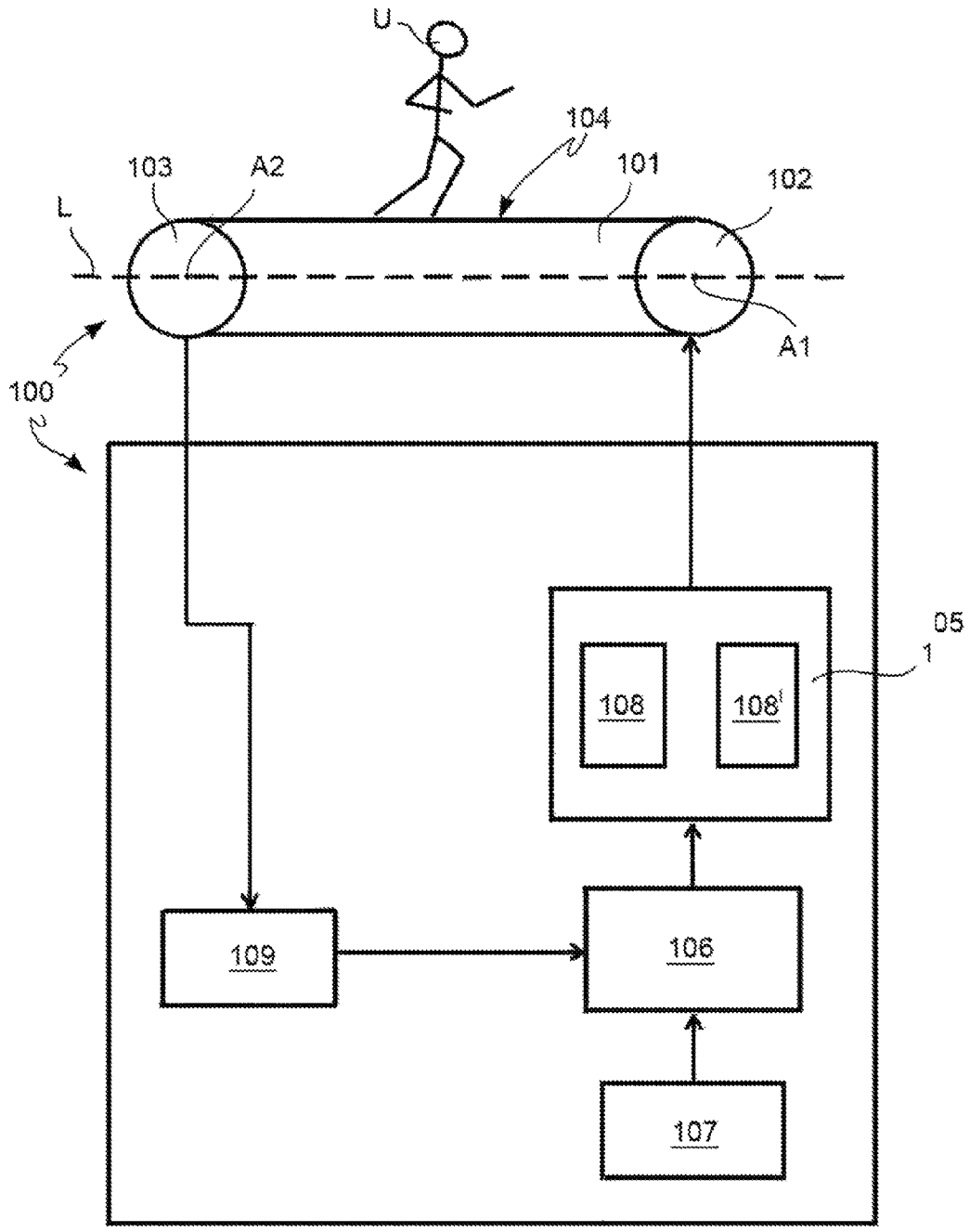
FIG. 3 shows, by means of a block chart, a treadmill with control of the respective operation according to a further embodiment of the present invention.

In a further embodiment, shown in FIG. 3, the actuation device 105 comprises a motor 108 and a brake 108', both operatively associated with and controllable by the data processing unit 106.

In this embodiment, the processing unit 106 is configured to control the motor 108 and the brake 108' separately.

In this embodiment, the motor 108 is configured to apply the driving action on the physical exercise surface 104 on the basis of respective commands received from the data processing unit 106, whilst the brake 108' is configured to apply the braking action on the physical exercise surface 104 during the braking action on the basis of respective commands received from the data processing unit 106.

It is worth noting that the motor 108 is adapted to apply the driving action on the physical exercise surface by acting on at least one of the first rotary element 102 and the second rotary element 103.

Instead, it is worth noting that the brake 108' is adapted to apply the braking action on the physical exercise surface 104 by acting on the motor 108.

In this embodiment, examples of motors 108 may be electrical brushless type motors, asynchronous electrical motors, variable reluctance electrical motors, direct current electrical motors, and so on, whilst, examples of brakes 108' may be regenerative brakes (e.g. generators), permanent magnet magnetic brakes, eddy electrical current brakes, friction mechanical brakes, and so on.

Referring now to any one of the embodiments described above, reference will generally be made hereinafter to the actuation device 105, irrespective of the aforesaid embodiments, to be considered mutually either in combination or alternatively.

In other words, if the actuation device 105 is configured to apply a braking action on the physical exercise surface 104 on the basis of commands received from the data processing unit 106, it means that such a braking action is applied either by the motor 108 or by the brake 108'.

Turning back to the example in FIG. 1, the treadmill 100 further comprises at least one detecting sensor 109 of at least a first parameter representative of the interaction between the user U and the physical exercise surface 104, hereinafter simply at least one sensor 109.

For the purposes of the present invention, "parameter representative of the interaction between the user and the physical exercise surface" means any parameter which can be detected on the treadmill 100 (e.g. kinematic parameters, such as the speed or the acceleration of the physical exercise surface 104 or the rotation speed of at least one of the first rotary element 102 and the second rotary element 103 or of the actuation device 105, or dynamic parameters such as the braking torque of the actuation device 105 or of at least one of the first rotary element 102 and the second rotary element) or any other parameter which can be detected on the user U (e.g. heart rate), the variation of which is correlated with the interaction between the user U and the physical exercise surface 104 during the use of the treadmill 100.

It is worth noting that the word "torque" means, according to the employed actuation device 105 according to one of the embodiments in FIGS. 1-3, either the braking torque applied by the motor 108, if the actuation device 105 comprises only the motor 108 (FIG. 1), or the braking torque applied by the brake 108', if the actuation device 105 comprises both the motor 108 and the brake 108' (FIG. 2) and if the actuation device 105 comprises only the brake 108' (FIG. 3).

In this regard, it is worth noting that, according to the employed actuation device 105, according to one of the embodiments in FIGS. 1-3, braking torque means both a resistant torque adapted to oppose the movement of the user U on the physical exercise surface 104 and a non-resistant torque, i.e. adapted to oppose the movement of the user U on the physical exercise surface 104.

Hereinafter, reference will also be made simply to "torque" always meaning in all cases the "braking torque" as defined above.

The at least one sensor 109 comprises a sensor positioned and chosen according to the parameter which must be detected for controlling the braking action of the actuation device 105, by actuating either the motor 108 or the brake 108', according to one or more embodiments, mutually in combination or alternatively, which were described above and will be described in greater detail below.

In an embodiment, the at least one sensor 109 comprises a speed sensor for detecting kinematic parameters.

Examples of speed sensor are: an encoder, an accelerometer, a gyroscope, a combination of these or other technical equivalent.

In another embodiment, in combination or alternatively, the at least one sensor 109 comprises a torque sensor for detecting dynamic parameters.

Examples of torque sensor are: a torsion meter, one or more load cells, one or more strain gauges, a combination of these or other technical equivalent and so on.

In a further embodiment, in combination or alternatively to those above, the at least one sensor 109 comprises a heart rate monitor for detecting the user's heart rate.

Heart rate monitor means a sensor integrated in the treadmill 100, e.g. the so-called hand-sensors inserted in the grips of the frame, or a sensor wearable by the user U but in all cases operatively associated with the treadmill 100.

Indeed, in the latter embodiment, a first component of the sensor 109 adapted to detect the heartbeat is worn in contact with the user (e.g. band, wristband and so on) and a second component of the sensor 109 adapted to receive the electrical signal detected and transmitted by the first component is integrated in the treadmill 100.

In further embodiments, more in detail, the at least one sensor 109 may also be one or more combinations of the sensors indicated above.

Turning generally back to the at least one sensor 109, as shown, for example, in FIG. 1, 2 or 3, it is operatively associated with the data processing unit 106 to provide said at least one detected parameter representative of the interaction between the user U and the physical exercise surface 104 to the data processing unit 106.

In this regard, if the at least one sensor 109 is a heart rate monitor either wearable by the user U or integrated in the treadmill 100, the treadmill 100 comprises a data communication module (not shown in the figures) operatively associated with the data processing unit 106 configured to receive data from the heart rate monitor by means of a data communication channel of the wireless type (e.g. a Bluetooth, NFC or Wi-Fi technology type data communication channel) or by means of a data communication channel of the wired type, if the heart rate monitor is physically connected to the treadmill 100.

In a further embodiment, in combination or alternatively to those described above, the treadmill 100 also comprises a further sensor (not shown in the figures) for detecting at least one electrical disturbance in the actuation device 105.

Examples of such a sensor are: an electrical current sensor (e.g. for detecting the electrical current drawn by the actuation device 105), an electrical voltage sensor (for example for detecting the electrical voltage drawn by the actuation device 105).

The further sensor is, for example, integrated in an electrical board of the actuation device 105.

Turning generally back now to the processing unit 106, the data processing unit 106 is advantageously configured to modulate at least one electrical control parameter of the actuation device 105 operatively associated with at least one of the first rotary element 102 and the second rotary element 103 on the basis of said at least a first parameter representative of the interaction between the user and the physical exercise surface 104 detected by said at least one sensor 109.

In particular, the data processing unit 106 is configured to carry out such a modulation to keep the second parameter representative of the interaction between the user U and the physical exercise surface 104 substantially equal to the set reference value of the at least a second parameter representative of the interaction between the user U and the physical exercise surface 104.

It is worth noting that the sampling time of the aforesaid modulation, by means of the data processing unit 106, according to various embodiments, is comprised in the range from a few tens of milliseconds to a few hundreds of milliseconds.

The "parameter representative of the interaction between the user and the physical exercise surface" has been defined above for the purposes of the present description.

Furthermore, "electrical control parameter of the actuation device" means the drawn electrical current or electrical voltage of the actuation device 105.

Hereinafter in the description, reference is also made to the drawn electrical current or electrical voltage simply by using the words electrical current or electrical voltage.

It is worth noting that, in an embodiment, the data processing unit 106 is configured to provide the set reference value of at least a second parameter representative of the interaction between the user U and the physical exercise surface 104.

In greater detail, the data processing unit 106 is configured to select the set reference value of at least a second parameter representative of the interaction between the user U and the physical exercise surface 104 from a set of reference values previously stored in the memory unit 107.

It is worth noting that the set reference value of at least a second parameter representative of the interaction between the user U and the physical exercise surface 104 may occur after the user U has chosen a type of training to be performed on the treadmill 100.

In this regard, it is worth noting that, in an embodiment, the set reference value of at least a second parameter representative of the interaction between the user U and the physical exercise surface 104 is invariable over time.

According to a further embodiment, alternative to that just described above, the set reference value of at least a second parameter representative of the interaction between the user U and the physical exercise surface 104 is equal to a reference function with variable progression over time.

The reference function with variable progression over time, possibly previously set, may vary during operation according to a function with predetermined variable progression (e.g. in steps, ramps, increasing, decreasing, mixed and so on).

In an embodiment, said at least a first parameter representative of the interaction between the user U and the physical exercise surface 104 is different from said at least a second parameter representative of the interaction between the user U and the physical exercise surface 104.

Figure 6:
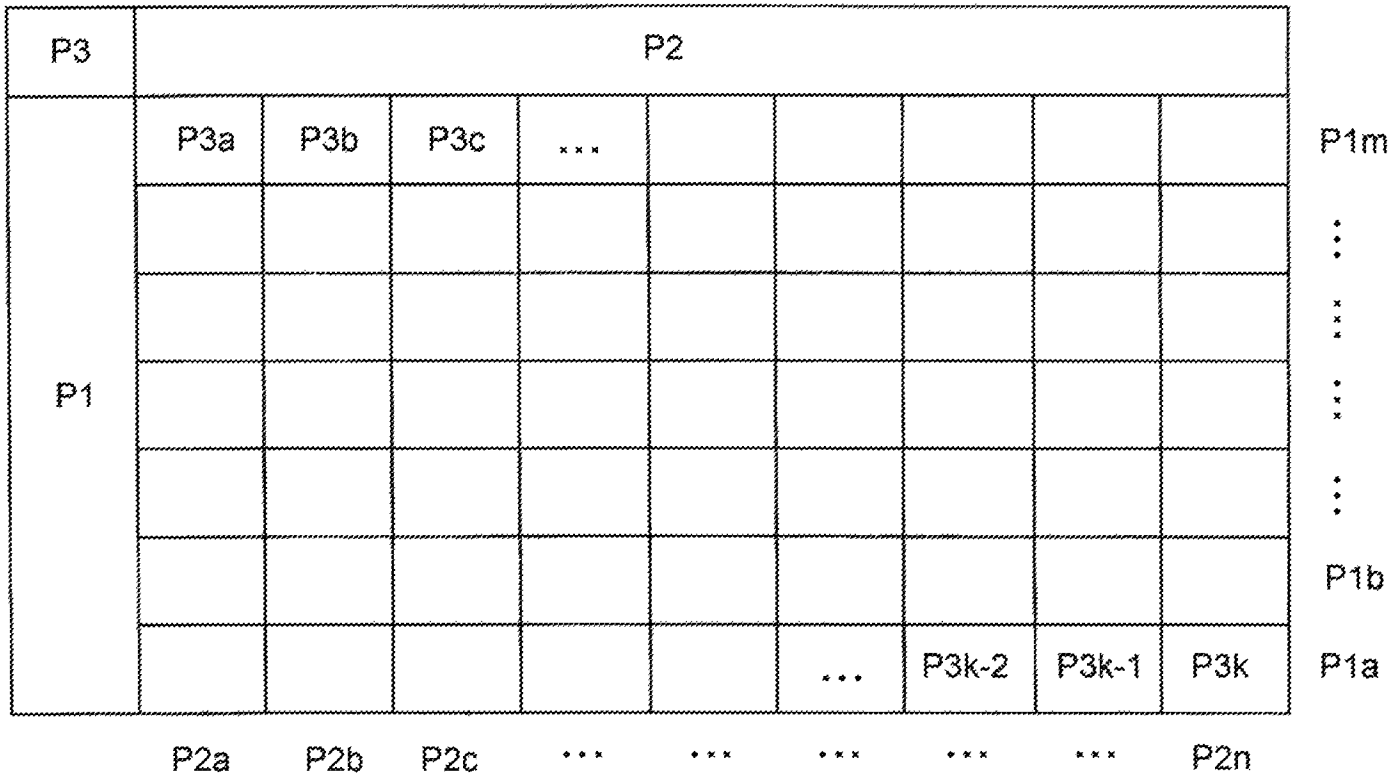

In this regard, said at least a first parameter representative of the interaction between the user U and the physical exercise surface 104, said at least a second parameter representative of the interaction between the user U and the physical exercise surface 104 and said at least one electrical control parameter of the actuation device 105 may be mutually in relation as a function of a specific algorithm based, for example, on a value table, like that shown in FIG. 6.

In such a table, said at least a second parameter, generally indicated by reference P2, is shown on the abscissa axis, and a set reference value of said at least a second parameter P2*a*, P2*b*, P2*c*, . . . , P2*n* is associated with each column of the table.

The at least a first parameter, generally indicated by reference P1, is represented on the ordinate axis, and a set reference value of said at least a first parameter P1*a*, P1*b*, P1*c*, . . . , P1*m* is associated with each line of the table.

The at least one control parameter, generally indicated by reference P3, is associated with a set value P3*a*, P3*b*, P3*c*, . . . , P3*k*−1, P3*k* in each box of the table, at a set value of said at least a second parameter P2 and of said at least a first parameter P1.

The data processing unit 106 is configured to modulate the control parameter so that it corresponds to the set control parameter which can be obtained from the table in the following manner: having chosen a column of the table (on the basis of the choice made by the user of a set type of training corresponding to a set reference value of said at least a second parameter, e.g. the braking torque) and having selected a line of the column, on the basis of the detected value of said at least a first parameter P1 (e.g. the speed), the reference value of said at least one electrical parameter to be modulated (e.g. the electrical current) is obtained.

For example, if the value of at least one said second parameter P2 is P2*b* and the detected value of said at least a first parameter P1 is P1*m*, then the reference value of said at least one control parameter P3 is equal to P3*b* (table in FIG. 6).

In an embodiment, alternative to that described above, said at least a first parameter representative of the interaction between the user U and the physical exercise surface 104 coincides with said at least a second parameter representative of the interaction between the user U and the physical exercise surface 104. In this case, the treadmill 100 is controlled in feedback, without needing to resort to an algorithm based on a value table, as shown in FIG. 6, for example.

In such an embodiment, the data processing unit 106 is configured to modulate said at least one electrical control parameter of the actuation device 105 on the basis of the variation of the set reference value of said at least a first parameter representative of the interaction between the user U and the physical exercise surface 104 detected by said at least one sensor 109.

In an embodiment, in combination with any of those described above, the data processing unit 106 is configured to modulate said at least one electrical control parameter on the basis of the comparison of a set reference value of said at least one electrical control parameter, depending on the set reference value of said at least a second parameter representative of the interaction between the user U and the physical exercise surface 104 with said at least a first parameter representative of the interaction between the user U and the physical exercise surface 104 detected by at least one sensor 109, and said at least one electrical disturbance of the actuation device 105 detected by the further sensor of the treadmill 100.

For example, in the embodiment in which the data processing unit 106 uses the algorithm based on the value table (FIG. 6), once the reference value of said at least one control parameter P3 has been determined, the data processing unit 106 is configured to modulate the value of said at least one control parameter so that it is substantially equal to the reference value determined by the table.

The electrical control parameter to be modulated depends on the type of actuation device 105 employed, according to any one of the embodiments described above with reference to FIGS. 1-3.

For example, in the embodiment of FIG. 1, the electrical control parameter of the actuation device 105 to be modulated is the electrical current, whilst said at least one parameter representative of the interaction between the user U and the physical exercise surface 104 may be the speed of the physical exercise surface 104, and said at least a second parameter representative of the interaction between the user U and the physical exercise surface 104 may be the braking torque of the actuation device 105 or of at least one of the first rotary element 102 and the second rotary element 103.

According to an embodiment, the data processing unit 106 is configured to torque control the actuation device 105 to allow the user U to employ the treadmill 100 for a so-called constant torque training.

In such an embodiment:

such at least a first parameter representative of the interaction between the user U and the physical exercise surface 104 is the speed of forward motion of the physical exercise surface 104 or the rotation speed of at least one of the first rotary element 102 and the second rotary element 103 or of the actuation device 105; thus, the at least one sensor 109 is a speed sensor;

the at least a second parameter representative of the interaction between the user U and the physical exercise surface 104 is the braking torque of the actuation device 105 or of at least one of the first rotary element 102 and the second rotary element 103.

In such an embodiment, the data processing unit 106 is configured to modulate said at least one electrical control parameter of the actuation device 105, e.g. the drawn electrical current of the actuation device 105, on the basis of the variation of the speed of forward motion of the physical exercise surface 104 or the rotation speed of at least one the first rotary element 102 and the second rotary element 103 or of the actuation device 105 detected by said at least one sensor 109 for maintaining the braking torque of the actuation device 105 or of at least one of the first rotary element 102 and the second rotary element 103 substantially equal to the set braking torque reference value.

According to a further embodiment, the data processing unit 106 is configured, in all cases, to torque control the actuation device 105 to allow the user U to employ the treadmill 100 for a so-called constant torque training.

In such an embodiment:

such at least a first parameter representative of the interaction between the user U and the physical exercise surface 104 is the braking torque of the actuation device 105 or of at least one of the first rotary element 102 and the second rotary element 103; thus, the at least one sensor 109 is a torque sensor;

the at least a second parameter representative of the interaction between the user U and the physical exercise surface 104 is the braking torque of the actuation device 105 or of at least one of the first rotary element 102 and the second rotary element 103.

In such an embodiment, the data processing unit 106 is configured to modulate said at least one control parameter of the actuation device 105, e.g. the drawn electrical current of the actuation device 105, on the basis of the variation of said set reference value of the braking torque of the actuation device 105 or of at least one of the first rotary element 102 and the second rotary element 103 detected by at least one sensor 109.

Notwithstanding the above description, irrespective of the employed sensor (speed or torque), according to a further embodiment in which the actuation device 105 comprises the motor 108, the set reference value of braking torque is equal to a reference function with a variable progression over time, in particular variable from a first reference value corresponding to a braking action applied by the motor 108 to a second reference value representative of the driving action of the motor 108.

In particular, the data processing unit 106 is configured to modulate said at least one electrical control parameter of the actuation device 105 to maintain the braking torque substantially equal to the set first reference value, so as to oppose the motion of the user U on the physical exercise surface 104.

The data processing unit 106 is further configured to pass from a resistant action to a driving action of the motor 108 for a transient set period of time.

The data processing unit 106 is configured to modulate said at least one electrical control parameter of the actuation device 105 to maintain the braking torque substantially equal to the set second reference value, so as not to oppose the motion of the user U on the physical exercise surface 104.

The operative steps can be repeated to pass from a driving action to a resistant action of the motor 108.

It is worth noting that in this embodiment, the data processing unit 106 is configured to allow the user U to employ the treadmill 100 for a so-called torque inversion training.

Notwithstanding the above description, irrespective of the sensor employed (speed or torque sensor), according to a further embodiment, the set braking torque reference value is equal to a reference function with variable progression over time, in particular variable from a first reference value to a second reference value.

The first reference value is substantially maintained for a first interval of time in which the user U applies a thrust (or pull) performed on a rest provided on the treadmill 100 and/or by coupling to a tow, according to one of the previously defined methods (coupling to the wall).

The second reference value must be substantially maintained in a second interval of time in which the user runs on the treadmill 100.

The passage from the first interval of time (thrust) to the second interval of time (running) is carried out by means of a transient interval of time chosen either automatically by the data processing unit 106, appropriately configured, as a function of the comparison of a value of a parameter representative of the thrust applied by the user U with a respective reference value or manually by the user, e.g. by means of a command placed on the frame of the treadmill 100.

It is worth noting that the parameter representative of the thrust applied by the user may be simply the thrusting time, the distance traveled by the user U while thrusting, the entity of the thrust or pull detected by means of a specific sensor (e.g. a load cell) with which the support structure or directly the cord used for pulling is equipped.

In this embodiment, the data processing unit 106 is configured to pass from a braking torque value (e.g. positive) to a further braking torque value (e.g. negative) for a set transient period of time, when a parameter representative of the thrust applied by the user U, detected by the processing unit 106, reaches a respective reference value or in which the user U imparts a manual command.

It is worth noting that in this embodiment, the data processing unit 106 is configured to allow the user U to employ the treadmill 100 for a so-called torque inversion training, such as sprint running, from a step of thrusting or pulling according to the coupling mode of the user U.

According to an embodiment, the data processing unit 106 is configured to speed control the actuation device 105 to allow the user U to employ the treadmill 100 for a so-called constant speed training.

In such an embodiment:

both said at least a first parameter representative of the interaction between the user U and the physical exercise surface 104 and said at least a second parameter representative of the interaction between the user U and the physical exercise surface 104 are either the speed of forward motion of the physical exercise surface 104 or the rotation speed of at least one of the first rotary element 102 and the second rotary element 103 or of the actuation device 105; thus, the at least one sensor 109 is a speed sensor.

In such an embodiment, the data processing unit 106 is configured to modulate said at least one electrical control parameter of the actuation device 105 (e.g. the drawn electrical current of the actuation device 105) on the basis of the variation of the speed of forward motion of the physical exercise surface 104 or the rotation speed of at least one of the first rotary element 102 and the second rotary element 103 or of the actuation device 105 detected by said at least one sensor 109 from said set reference value.

According to an embodiment, the data processing unit 106 is configured to power control the actuation device 105 to allow the user U to employ the treadmill 100 for a so-called constant power training.

In such an embodiment:

such at least a first parameter representative of the interaction between the user U and the physical exercise surface 104 is the speed of forward motion of the physical exercise surface 104 or the rotation speed of at least one of the first rotary element 102 and the second rotary element 103 or of the actuation device 105; thus, the at least one sensor 109 is a speed sensor;

the at least a second parameter representative of the interaction between the user U and the physical exercise surface 104 is the power of the actuation device 105.

In such an embodiment, the data processing unit 106 is configured to modulate said at least one electrical control parameter of the actuation device 105 (e.g. the drawn electrical current of the actuation device 105) on the basis of the variation of the speed of forward motion of the physical exercise surface 104 or the rotation speed of at least one of the first rotary element 102 and the second rotary element 103 or of the actuation device 105 detected by said at least one sensor 109 to maintain the power substantially equal to the set power reference value of the actuation device 105.

It is worth noting, for example, that the value of said at least one electrical control parameter of the actuation device 105 with which to modulate the actuation device 105 is obtained by the data processing unit 106 as a function of a set braking torque reference value of the actuation device 105 or of at least one of the first rotary element 102 and the second rotary element 103, calculated from the set power reference value of the actuation device 105 on the basis of the detected speed (torque=power/speed).

According to a further embodiment, wherein the data processing unit 106 is configured in all cases to power control the actuation device 105 to allow the user U to employ the treadmill 100 for a so-called constant power training:

such at least a first parameter representative of the interaction between the user U and the physical exercise surface 104 is the braking torque of the actuation device 105 or of at least one of the first rotary element 102 and the second rotary element 103; thus, the at least one sensor 109 is a torque sensor;

the at least a second parameter representative of the interaction between the user U and the physical exercise surface 104 is the power of the actuation device 105.

In such an embodiment, the data processing unit 106 is configured to modulate said at least one electrical control parameter of the actuation device 105 (e.g. the drawn electrical current of the actuation device 105) on the basis of the torque variation detected by the torque sensor to maintain the power of the actuation device 105 substantially equal to the set reference value of the power of the actuation device 105.

It is worth noting that said at least one electrical control parameter of the actuation device 105 with which to modulate the actuation device 105 is obtained from the data processing unit 106 as a function of the braking torque value detected by the torque sensor on the basis of the speed calculated on the basis of the set reference power value of the actuation device 105 on the basis of the detected torque (speed=power/torque).

According to an embodiment, the data processing unit 106 is configured to control the heart rate of the user U to allow him or her to employ the treadmill 100 for a so-called constant heart rate training.

In such an embodiment:

such at least a first parameter representative of the interaction between the user U and the physical exercise surface 104 is the heart rate; thus, at least one sensor 109 is a heart rate monitor;

the treadmill 100 comprises a further detecting sensor (not shown in the figures) of the speed of forward motion of the physical exercise surface 104 or the rotation speed of at least one of the first rotary element 102 and the second rotary element 103 or of the actuation device 105;

the at least a second parameter representative of the interaction between the user U and the physical exercise surface 104 is the heart rate frequency.

In such an embodiment, the data processing unit 106 is configured to modulate said at least one electrical control parameter of the actuation device 105, thus determining a set power value of the actuation device 105 on the basis of the deviation of the heart rate frequency detected by the heart rate monitor 109 and the set heart rate reference value.

Furthermore, the data processing unit 106 is configured to modulate said at least one electrical control parameter of the actuation device 105 further determining a further braking torque reference value on the basis of the previously determined set power value and the speed detected by the further speed sensor (torque=power/speed).

The data processing unit 106 is configured to modulate said at least one electrical control parameter of the actuation device 105 by modulating said at least one electrical control parameter of the actuation device 105 (e.g. the drawn electrical current of the actuation device 105) on the basis of the speed value detected by the further speed sensor, to maintain the braking torque substantially equal to the determined braking torque reference value.

According to other embodiments, the data processing unit 106 can be configured to allow the user U to employ the treadmill 100 for combined type training, in which one or more thrusting exercises, i.e. a combination of training at constant speed, at constant torque, at variable torque, at constant heart rate, at variable heart frequency, and so on, are mutually alternated with the standard running/walking performed by a user U on the treadmill 100.

In other words, the treadmill 100 of the invention may be considered as configured to operate in "passive" mode (for thrusting exercises), in which the control of the braking action is enabled/actuated according to one of the modes described above, or in "active" mode (for traditional running/walking).

It is worth noting that according to any one of the embodiments described above, the data processing unit 106 is configured to provide the set reference value of said at least a second parameter representative of the interaction between the user U and the physical exercise surface 104 by selecting such a value between a set of reference values previously stored in the memory unit 107.

In particular, the selection of the set reference value of said at least second parameter representative of the interaction between the user U and the physical exercise surface 104 may occur following the choice by the user U of a type of training to be performed on the treadmill 100.

If a controlled torque training program is chosen, said at least a second parameter representative of the interaction between the user U and the physical exercise surface 104 is the braking torque.

If a constant speed training program is chosen, said at least a second parameter representative of the interaction between the user U and the physical exercise surface 104 is the speed.

If the power control training program is chosen, said at least a second parameter representative of the interaction between the user U and the physical exercise surface 104 is the power.

If a heart rate control training program is chosen, said at least a second parameter representative of the interaction between the user U and the physical exercise surface 104 is the heart rate.

According to any one of the embodiments described above with reference to thrusting exercises, the user U can thrust on the physical exercise surface 104 by thrusting on a rest with which the frame is equipped (e.g. the supporting structure defined by the frame of the treadmill 100) or being coupled to a tow (e.g. present on the external structure positioned near the treadmill 100 or on a wall near which the treadmill 100 is positioned).

It is worth noting that in any one of the embodiments described above, for the purpose of modulating at least one electrical control parameter of the actuation device 105 (e.g. the drawn electrical current of the actuation device 105), the data processing unit 106 is configured to modulate such an electrical control parameter on the basis of the comparison of a set reference value, depending on the set reference value of the braking torque and of the speed detected by the speed sensor, and said at least one electrical disturbance of the actuation device 105 detected by the further sensor of the treadmill 100.

Again, it is worth noting that, as previously mentioned, according to any one of the embodiments described above, a set reference value of said at least a second parameter representative of the interaction between the user U and the physical exercise surface 104 (braking torque, speed, power or heart rate) may be variable over time or may be equal to a reference function with variable progression over time (described above).

Furthermore, it is worth noting that the described operations, in each of the embodiments described above, are carried out by the data processing unit 106 both at the beginning of the training, when the physical exercise surface 104 is either stationary or at a minimum constant speed of forward motion, when the user U applies an initial thrust on the physical exercise surface 104 and set it in movement, and after the initial thrust, when the user U applies a thrust on the physical exercise surface 104 to maintain the physical exercise surface 104 (belt or slat) moving.

With reference to the block chart in FIG. 4, a method 400 for controlling the operation of a treadmill 100, hereinafter also simply referred to as method 400 will be described.

The treadmill 100 is entirely similar to that described above.

The method 400 comprises a symbolic step of starting ST.

The method 400 comprises a step of detecting 401, by at least one detecting sensor 109 with which the treadmill 100 is equipped, at least a first parameter representative of the interaction between a user U and a physical exercise surface 104 of the treadmill 100.

The at least one detecting sensor 209 and said at one parameter representative of the interaction between a user U and the physical exercise surface 104 have been described above.

The method 400 further comprises a step of providing 402, by the data processing unit 106 with which the treadmill 100 is equipped, at least one set reference value of a second parameter representative of the interaction between the user U and the physical exercise surface 104.

The method 400 further comprises a step of modulating 403, by the data processing unit 106, at least one electrical control parameter of an actuation device 105 operatively associated with at least one of a first rotary element 102 and a second rotary element 103 with which the treadmill 100 is equipped, on the basis of said at least a first parameter representative of the interaction between the user U and the physical exercise surface 104 detected by said at least one sensor 109.

In particular, the step of modulating 403 is carried out to keep the second parameter representative of the interaction between the user U and the physical exercise surface 104 substantially equal to the set value of said at least a second parameter representative of the interaction between the user U and the physical exercise surface 104.

The actuation device 105, according to various embodiments and said at least one electrical control parameter of the actuation device 105 have been described above.

In an embodiment, said at least a first parameter representative of the interaction between the user U and the physical exercise surface 104 is different from said at least a second parameter representative of the interaction between the user U and the physical exercise surface 104.

In such an embodiment, the step of modulating 403 said at least one electrical control parameter of the actuation device 105 is carried out, by the data processing unit 106, on the basis of the variation of said at least a first parameter representative of the interaction between the user U and the physical exercise surface 104 detected by said at least one sensor 109 for maintaining said at least a second parameter representative of the user U and the physical exercise surface 104 substantially equal to the set reference value of said at least a second parameter representative of the interaction between the user U and the physical exercise surface 104 (the possible relationship between the aforesaid parameters was described above with reference to the table in FIG. 6).

In an embodiment, alternative to that described above, said at least a first parameter representative of the interaction between the user U and the physical exercise surface 104 coincides with said at least a second parameter representative of the interaction between the user U and the physical exercise surface 104.

In such an embodiment, the step of modulating 402 said at least one electrical control parameter of the actuation device 105 is carried out by the data processing unit 106, on the basis of the variation of the set reference value of said at least a first parameter representative of the interaction between the physical exercise surface 104 detected by said at least one sensor 109.

According to an embodiment (constant torque training):

such at least a first parameter representative of the interaction between the user U and the physical exercise surface 104 is the speed of forward motion of the physical exercise surface 104 or the rotation speed of at least one of the first rotary element 102 and the second rotary element 103 or the actuation device 105; thus, at least one sensor 109 is a speed sensor;

the at least a second parameter representative of the interaction between the user U and the physical exercise surface 104 is the braking torque of the actuation device 105 or of at least one of the first rotary element 102 and the second rotary element 103.

In such an embodiment, the step of modulating 403 said at least one electrical control parameter of the actuation device 105 (e.g. the drawn electrical current of the actuation device 105) is carried out by the data processing unit 106, on the basis of the variation of the speed of forward motion of the physical exercise surface 104 or the rotation speed of at least one of the first rotary element 102 and the second rotary element 103 or of the actuation device 105 detected by said at least one sensor 109 for maintaining the braking torque of the actuation device 105 or of at least one of the first rotary element 102 and the second rotary element 103 substantially equal to the set reference value of braking torque.

According to a further embodiment (constant torque training):

such at least a first parameter representative of the interaction between the user U and the physical exercise surface 104 is the braking torque of the actuation device 105 or of at least one of the first rotary element 102 and the second rotary element 103; thus, the at least one sensor 109 is a torque sensor;

the at least a second parameter representative of the interaction between the user U and the physical exercise surface 104 is the braking torque of the actuation device 105 or of at least one of the first rotary element 102 and the second rotary element 103.

In such an embodiment, the step of modulating 403 said at least one electrical control parameter of the actuation device 105 (e.g. the drawn electrical current of the actuation device 105) is performed, by the data processing unit 106, on the basis of the variation of the braking torque of the actuation device 105 or of a least one of the first rotary element 102 and the second rotary element 103 detected by said at least one sensor 109 by said at least said reference value.

According to any one of the two embodiments described above (torque control training), if the actuation device 105 comprises a motor 108, the set braking torque reference value is equal to a reference function with variable progression over time, in particular variable from a first reference value corresponding to a braking action applied by the motor 108 to a second reference value corresponding to the driving action of the motor 108.

In such an embodiment (torque inversion training), the step of modulating 403 is carried out by the data processing unit 106 to maintain the braking torque substantially equal to the set reference value so as to oppose to the motion imposed by the user U on the physical exercise surface 104.

In such an embodiment, the step of modulating 403 comprises a step of passing 404 from a resistant action to a driving action of the motor 108 for an set transient period of time.

The step of modulating 403 is further carried out, by the data processing unit 106, to keep the braking torque substantially equal to the set second reference value, so as not to oppose the motion of the user U on the physical exercise surface 104.

The steps of the method described above may be repeated to pass from a driving action to a resistant action of the motor 108.

According to a further embodiment (torque inversion training, typical for sprint running, from a step of thrusting or pulling, according to the coupling mode of the user U), the set braking torque reference value is equal to a reference function with variable progression over time, in particular variable from a first reference value to a second reference value.

In such an embodiment, the step of modulating 403 is carried out, by the data processing unit 106, with respect to the first reference value for a first interval of time in which the user U applies a thrust (according to one of the methods described above) and respect to the second reference value in a second interval of time in which the user runs on the treadmill 100.

The passage from the set first reference value to the set second reference value is carried out either automatically by the data processing unit 106, appropriately configured, as a function of the comparison of a value of a parameter representative of the thrust applied by the user U with a respective reference value, or chosen manually by the user, e.g. by means of a command placed on the frame of the treadmill 100.

Examples of parameter representative of the push applied by the user are described above.

In this embodiment, the step of modulating 403 comprises a step of passing 404', by the data processing unit 106, when a parameter representative of the thrust applied by the user U, detected by the processing unit 106, reaches a respective reference value or the user U imparts a manual command, from a braking torque value (e.g. positive) to a further braking torque value (e.g. negative) for a set transient period of time.

According to an embodiment (constant torque training):

both said at least a first parameter representative of the interaction between the user U and the physical exercise surface 104 and said at least a second parameter representative of the interaction between the user U and the physical exercise surface 104 are either the speed of forward motion of the physical exercise surface 104 or the rotation speed of at least one of the first rotary element 102 and the second rotary element 103 or of the actuation device 105; thus, the at least one sensor 109 is a speed sensor.

In such an embodiment, the step of modulating 403 said at least one electrical control parameter of the actuation device 105 (e.g. the drawn electrical current of the actuation device 105) is carried out by the data processing unit 106, on the basis of the variation of the speed of forward motion of the physical exercise surface 104 or the rotation speed of at least one of the first rotary element 102 and the second rotary element 103 or the actuation device 105 detected by said at least one sensor 109 from said set reference value.

According to an embodiment (constant power training):

such at least a first parameter representative of the interaction between the user U and the physical exercise surface 104 is the speed of forward motion of the physical exercise surface 104 or the rotation speed of at least one of the first rotary element 102 and the second rotary element 103 or the actuation device 105; thus, the at least one sensor 109 is a speed sensor;

the at least a second parameter representative of the interaction between the user U and the physical exercise surface 104 is the power of the actuation device 105.

In such an embodiment, the step of modulating 403 said at least one electrical control parameter of the actuation device 105 (e.g. the drawn electrical current of the actuation device 105) is carried out by the data processing unit 106, on the basis of the variation of the speed of forward motion of the physical exercise surface 104 or the rotation speed of at least one of the first rotary element 102 and the second rotary element 103 or of the actuation device 105 detected by said at least one sensor 109 for maintaining the power of the actuation device 105 substantially equal to the set power reference value.

In particular, the step of modulating 403 comprises a step of obtaining 405, by the data processing unit 106, the value of said at least one electrical control parameter (e.g. the drawn electrical current of the actuation device 105) with which to modulate the actuation device 105 as a function of a set reference braking torque value of the actuation device 105 or of at least one of the first rotary element 102 and the second rotary element 103, calculated from the set reference power value of the actuation device 105 on the basis of the detected speed (torque=power/value).

According to a further embodiment (constant power training):

such at least a first parameter representative of the interaction between the user U and the physical exercise surface 104 is the braking torque of the actuation device 105 or of at least one of the first rotary element 102 and the second rotary element 103; thus, the at least one sensor 109 is a torque sensor;

the at least a second parameter representative of the interaction between the user U and the physical exercise surface 104 is the power of the actuation device 105.

In such an embodiment, the step of modulating 403 said at least one electrical control parameter of the actuation device 105 (e.g. the drawn electrical current of the actuation device 105) is carried out by the data processing unit 106, on the basis of the torque variation detected by the torque sensor to maintain the power of the actuation device 105 substantially equal to the set power reference value.

The step of modulating 403 comprises a step of obtaining 406, by the data processing unit 106, the value of said at least one electrical control parameter (e.g. the drawn electrical current of the actuation device 105) with which to modulate the actuation device 105 as a function of the braking torque value detected by the torque sensor on the basis of the speed calculated from the set reference power value of the actuation device 105 on the basis of the detected torque (speed=power/torque).

According to an embodiment (constant heart rate training):

such at least a first parameter representative of the interaction between the user U and the physical exercise surface 104 is the heart rate; thus, at least one sensor 109 is a heart rate monitor;

the treadmill 100 comprises a further detecting sensor (not shown in the figures) of the speed of forward motion of the physical exercise surface 104 or the rotation speed of at least one of the first rotary element 102 and the second rotary element 103 or of the actuation device 105;

the at least a second parameter representative of the interaction between the user U and the physical exercise surface 104 is the heart rate frequency.

In such an embodiment, the step of modulating 403 said at least one electrical current of the actuation device 105 (e.g. the drawn electrical current of the actuation device 105) comprises the steps of:

determining 407, by the data processing unit 106, a set power value of the actuation device 105 on the basis of the heart rate deviation detected by the heart rate monitor 109 and the set reference heart rate value;

further determining 408, by the data processing unit 106, a reference braking torque value on the basis of the previously determined set power value and the speed detected by the further speed sensor (torque=power/speed).

Again, the step of modulating 403 comprises a further step of modulating 409, by the data processing unit 106, said at least one electrical control parameter of the actuation device 105 (e.g. the drawn electrical current of the actuation device 105) on the basis of the speed value detected by the further speed sensor, to maintain the braking torque substantially equal to the reference value of the determined braking torque.

It is further worth noting that according to any one of the embodiments described above, for the purpose of modulating said at least one electrical control parameter of the actuation device 105 (e.g. the drawn electrical current of the actuation device 105), the step of modulating 403 said at least one electrical control parameter of the actuation device 105 (e.g. the drawn electrical current of the actuation device 105) is carried out by the data processing unit 106, on the basis of the comparison between a set reference value of said at least one electrical control parameter, depending on the set reference value of said at least a second parameter representative of the interaction between the user U and the physical exercise surface 104, and said at least one parameter representative of the interaction between the user U and the physical exercise surface 104 detected by said at least one sensor 109, and further of at least one electrical disturbance of the actuation device 105 detected by a further sensor with which the treadmill 100 is equipped.

The electrical disturbance of the actuation device 105 and the further sensor with which the treadmill 100 is equipped have been described above.

It is worth noting that according to any one of the embodiments described above (not shown in the figures), the step of providing 401 comprises a step of selecting 410, by the data processing unit 106, the set reference value of said at least second parameter representative of the interaction between the user U and the physical exercise surface 104 from a set of reference values previously stored in a memory unit 107 (described above) with which the treadmill 100 is equipped.

In particular, the set reference value of said at least second parameter representative of the interaction between the user U and the physical exercise surface 104 may occur following the choice by the user U of a type of training to be performed on the treadmill 100.

Examples of said at least a second parameter representative of the interaction between the user U and the physical exercise surface 104, selected by the data processing unit 106 according to the type of training chosen by the user, have been described above.

According to an embodiment, in which the actuation device 105 comprises at least one motor 108, the method 400 further comprises a step of controlling 411, by the data processing unit 106, at least one electrical control parameter of the motor 108 to generate a braking torque on said at least one of the first rotary element 102 and the second rotary element 103 in order to apply a braking action on the physical exercise surface 104 in opposition to the action of the user U.

Again, it is worth noting that, as mentioned above, according to any one of the embodiments described above, the set reference value of said at least a second parameter representative of the interaction between the user U and the physical exercise surface 104 (braking torque, speed, power or heart rate) may be either variable over time or equal to a reference function with variable progression over time (described above).

Finally, it is worth noting that the steps of the method 400 just described above, according to any one of the embodiments, are carried out by the data processing unit 106 both at the start of training when the physical exercise surface 104 is stationary or at a minimum constant speed of forward motion, when the user U applies an initial thrust on the physical exercise surface 104 and set it in movement, and then after the initial thrust, when the user U applies a thrust on the physical exercise surface 104 to maintain the physical exercise surface 104 (belt or slat) moving.

Figure 4:
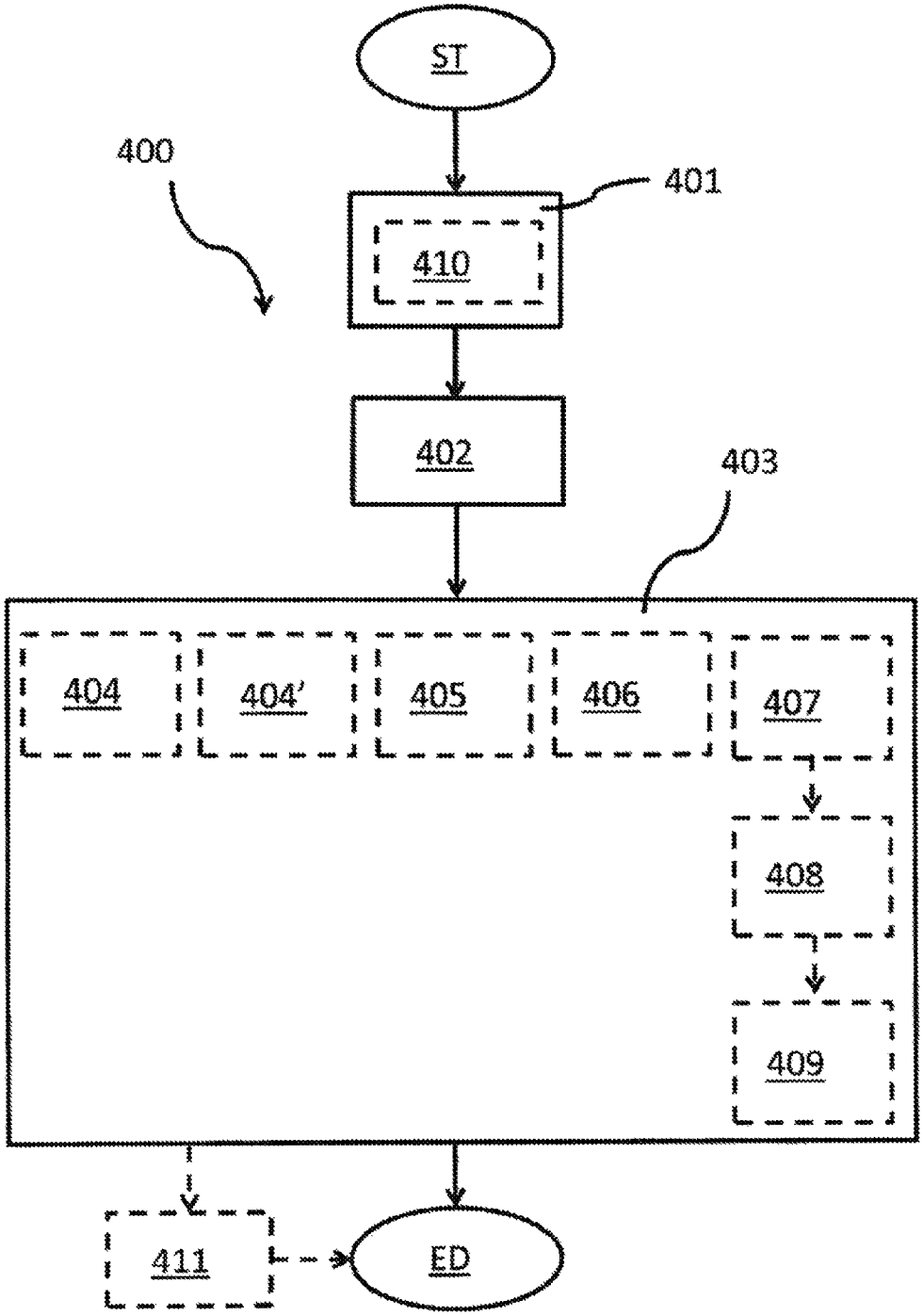
FIG. 4 shows, by means of a block chart, a method for controlling the operation of a treadmill, according to an embodiment of the present invention.

Turning generally back to the embodiment in FIG. 4, the method 400 comprises a symbolic step of ending ED.

According to a further aspect of the present invention, a program product can be uploaded on a memory unit (e.g. the memory unit 107 of the treadmill 100) of a computer (e.g. the data processing unit 106 of the treadmill 100.

The program product can be executed by the data processing unit 106 of the electronic computer (treadmill 100) to perform the steps of the method 400 for controlling the treadmill 100, described above with reference to FIG. 4 and according to the other described embodiments.

As can be seen, the purpose of the invention is achieved because the described treadmill and the respective control method have the following advantages.

Indeed, by virtue of the treadmill 100 of the invention, the user U can (either voluntarily or involuntarily) carry out with the same exercise machine (treadmill 100) various thrusting exercises also alternatively or in combination with traditional running/walking.

This certainly implies a considerable reduction of training times and costs.

Furthermore, the advantage of being able to allow the user U to carry out the physical activity (thrusting, running and walking exercises) as naturally and safety as possible is apparent.

Those skilled in art will be able to make changes, adaptations, and replacements of elements with functionally equivalent ones, to the embodiments of the method for controlling the treadmill, the treadmill and the respective program product described above without departing from the scope of the following claims. All the features described above as belonging to a possible embodiment may be implemented irrespective of the other embodiments described.

The invention claimed is:

1. A method for controlling the operation of a treadmill, comprising the steps of:

detecting, by at least one detecting sensor with which the treadmill is equipped, at least a first parameter representative of the interaction between a user and a physical exercise surface of the treadmill;

providing, by a data processing unit with which the treadmill is equipped, at least one set reference value of a second parameter representative of the interaction between the user and the physical exercise surface;

modulating, by the data processing unit, at least one electrical control parameter of an actuation device operatively associated with at least one of a first rotary element and a second rotary element with which the treadmill is equipped, on the basis of said at least a first parameter representative of the interaction between the user and the physical exercise surface detected by said at least one sensor, the step of modulating being carried out to keep the second parameter representative of the interaction between the user and the physical exercise surface substantially equal to the set reference value of said at least a second parameter representative of the interaction between the user and the physical exercise surface.

2. The method according to claim 1, wherein said at least a first parameter representative of the interaction between the user and the physical exercise surface is different from said at least a second parameter representative of the interaction between the user and the physical exercise surface.

3. The method according to claim 1, wherein said at least a first parameter representative of the interaction between the user and the physical exercise surface coincides with said at least a second parameter representative of the interaction between the user and the physical exercise surface, the step of modulating being carried out by modulating, by the data processing unit, said at least one electrical control parameter of the actuation device on the basis of the variation from the set reference value of said at least a first parameter representative of the interaction between the user and the physical exercise surface detected by said at least one sensor.

4. The method according to claim 2, wherein:

such at least a first parameter representative of the interaction between the user and the physical exercise surface is either the speed of forward motion of the physical exercise surface or the rotation speed of at least one of the first rotary element and the second rotary element or of the actuation device, the at least one sensor being a speed sensor;

the at least a second parameter representative of the interaction between the user and the physical exercise surface is the braking torque of either the actuation device or of at least one of the first rotary element and the second rotary element.

5. The method according to claim 3, wherein:

such at least a first parameter representative of the interaction between the user and the physical exercise surface is the braking torque of either the actuation device or of at least one of the first rotary element and the second rotary element, the at least one sensor being a torque sensor;

the at least a second parameter representative of the interaction between the user and the physical exercise surface is the braking torque of either the actuation device or of at least one of the first rotary element and the second rotary element;

the step of modulating said at least one electrical parameter of the actuation device being carried out, by the data processing unit, on the basis of the variation of the braking torque of either the actuation device or of at least one of the first rotary element and the second rotary element detected by said at least one sensor from said set reference value.

6. The method according to claim 4, wherein the actuation device comprises a motor, the set reference braking torque value being equal to a reference function with variable progression over time from a first reference value corresponding to a braking action exerted by the motor to a second reference value corresponding to a driving action of the motor, the step of modulating being carried out, by the data processing unit, to keep the braking torque substantially equal to the set first reference value, so as to oppose the motion of the user on the physical exercise surface;

the step of modulating comprising a step of passing from a resistant action to a driving action of the motor for a set transient period of time, the step of modulating further being carried out by the data processing unit, to keep the braking torque substantially equal to the set second reference value.

7. The method according to claim 6, wherein the set reference braking torque value is equal to a reference function with variable progression over time from a first reference value to a second reference value, the step of modulating being carried out, by the data processing unit, with respect to the first reference value for a first interval of time in which the user exerts a thrust and with respect to the second reference value in a second interval of time in which the user runs on the treadmill, the passage between the set first reference value and the set second reference value being carried out either automatically by the data processing unit as a function of the comparison of a value of a parameter representative of the push exerted by the user with a respective reference value, or manually by the user.

8. The method according to claim 3, wherein:

both said at least a first parameter representative of the interaction between the user and the physical exercise surface and said at least a second parameter representative of the interaction between the user and the physical exercise surface are either the speed of forward motion of the physical exercise surface or the rotation speed of at least one of the first rotary element and the second rotary element or of the actuation device, the at least one sensor being a speed sensor;

the step of modulating said at least one electrical control parameter of the actuation device being carried out, by the data processing unit, on the basis of the variation of either the speed of forward motion of the physical exercise surface or the rotation speed of at least one of the first rotary element and the second rotary element or of the actuation device detected by said at least one sensor from said set reference value.

9. The method according to claim 2, wherein:

such at least a first parameter representative of the interaction between the user and the physical exercise surface is either the speed of forward motion of the physical exercise surface or the rotation speed of at least one of the first rotary element and the second rotary element or of the actuation device, the at least one sensor being a speed sensor;

the at least a second parameter representative of the interaction between the user and the physical exercise surface is the power of the actuation device.

10. The method according to claim 9, wherein the step of modulating comprises a step of obtaining, by the data processing unit, the value of said at least one electrical control parameter with which to modulate the actuation device as a function of a set reference braking torque value of the actuation device or of at least one of the first rotary element and the second rotary element, calculated from the set reference power value of the actuation device on the basis of the detected speed.

11. The method according to claim 2, wherein:

such at least a first parameter representative of the interaction between the user and the physical exercise surface is the braking torque of the actuation device or of at least one of the first rotary element and the second rotary element, the at least one sensor being a torque sensor;

the at least a second parameter representative of the interaction between the user and the physical exercise surface is the power of the actuation device.

12. The method according to claim 11, wherein the step of modulating comprises a step of obtaining, by the data processing unit, the value of said at least one control parameter with which to modulate the actuation device as a function of the braking torque value detected by the torque sensor on the basis of the speed calculated from the set reference power value of the actuation device on the basis of the detected torque.

13. The method according to claim 3, wherein:

such at least a first parameter representative of the interaction between the user and the physical exercise surface is the heart rate, the at least one sensor being a heart rate monitor;

the treadmill comprises a further sensor for detecting either the speed of forward motion of the physical exercise surface or the rotation speed of at least one of the first rotary element and the second rotary element or of the actuation device;

the at least a second parameter representative of the interaction between the user and the physical exercise surface is the heart rate.

14. The method according to claim 13, wherein the step of modulating comprises the steps of:

determining, by the data processing unit, a set power value of the actuation device on the basis of the heart rate deviation detected by the heart rate monitor and the set reference heart rate value;

determining, by the data processing unit, a reference braking torque value on the basis of the previously determined set power value and the speed detected by the further speed sensor.

15. The method according to claim 14, wherein the step of modulating comprises a step of modulating, by the data processing unit, said at least one electrical control parameter of the actuation device on the basis of the speed value detected by the further speed sensor, to keep the braking torque substantially equal to the determined reference braking torque value.

16. The method according to claim 1, wherein the step of modulating said at least one electrical control parameter of the actuation device is carried out, by the data processing unit, on the basis of the comparison of a set reference value of said at least one electrical control parameter, dependent on the set reference value of said at least a second parameter representative of the interaction between the user and the physical exercise surface with said at least a first parameter representative of the interaction between the user and the physical exercise surface detected by said at least one sensor, and further at least one electrical disturbance of the actuation device detected by a further sensor with which the treadmill is equipped.

17. The method according to claim 1, wherein the step of providing the set reference value of said at least a second parameter representative of the interaction between the user and the physical exercise surface further comprises a step of selecting, by the data processing unit, the set reference value of said at least a second parameter representative of the interaction between the user and the physical exercise surface from a set of reference values previously stored in a memory unit with which the treadmill is equipped.

18. The method according to claim 1, wherein the set reference value of said at least a second parameter representative of the interaction between the user and the physical exercise surface can be unchangeable over time or be equal to a reference function with variable progression over time.

19. The method according to claim 1, wherein the actuation device comprises at least one motor, the method comprising a step of controlling, by the data processing unit, at least one electrical control parameter of the motor to generate a braking torque on said at least one of the first rotary element and the second rotary element in order to apply a braking action on the physical exercise surface in opposition to the action of the user.

20. A treadmill comprising:

a base extending along a longitudinal axis, said base comprising:

a first rotary element and a second rotary element configured to rotate about respective rotation axes transverse to the longitudinal axis of the base;

a physical exercise surface operatively connected to the first rotary element and to the second rotary element, an actuation device operatively associated with at least one of said first rotary element and the second rotary element, the actuation device being configured to rotate the first rotary element and the second rotary element, also causing the physical exercise surface to rotate;

a data processing unit, said actuation device being operatively associated with said data processing unit, at least one sensor for detecting at least a first parameter representative of the interaction between the user and the physical exercise surface, said at least one sensor being operatively connected to the data processing unit;

wherein the data processing unit is configured to:

provide at least one set reference value of a second parameter representative of the interaction between the user and the physical exercise surface;

modulate at least one electrical control parameter of the actuation device on the basis of said at least a first parameter representative of the interaction between the user and the physical exercise surface detected by said at least one sensor, the data processing unit being configured to modulate the at least one electrical control parameter of the actuation device to keep the second parameter representative of the interaction between the user and the physical exercise surface substantially equal to the set reference value of said at least a second parameter representative of the interaction between the user and the physical exercise surface.

21. The treadmill according to claim 20, wherein the actuation device comprises at least one motor operatively associated with and controllable by the data processing unit, the motor being configured to apply on at least one of the first rotary element and the second rotary element both the driving action and the braking action, on the basis of commands received by the data processing unit.

22. The treadmill according to claim 20, wherein the actuation device comprises at least one brake operatively associated with and controllable by the data processing unit.

* * * * *